US005317293A

United States Patent [19]

Bacon et al.

[11] Patent Number: 5,317,293

[45] Date of Patent: May 31, 1994

[54] WAVEGUIDE SWITCH CIRCUIT WITH IMPROVED SWITCHING AND TUNING CAPABILITY

[75] Inventors: Donald F. Bacon, Chelmsford; Howard M. Richards, Dracut, both of Mass.

[73] Assignee: Raytheon Company, Lexington, Mass.

[21] Appl. No.: 812,198

[22] Filed: Dec. 20, 1991

[51] Int. Cl.[5] ..... H01P 1/15

[52] U.S. Cl. ..... 333/258; 333/262

[58] Field of Search ..... 333/101, 103, 250, 258, 333/262

[56] References Cited

U.S. PATENT DOCUMENTS

| | | | |
|---|---|---|---|
| 3,287,665 | 11/1966 | Brunton, III | 333/258 |
| 3,516,031 | 6/1970 | Commerford | 333/258 |
| 3,868,607 | 2/1975 | Hulderman | 333/258 |
| 4,156,861 | 5/1979 | DeMambro et al. | 333/250 |
| 4,413,243 | 11/1983 | Dydyk | 333/258 |
| 4,583,058 | 5/1986 | McClymonds | 331/107 P |
| 4,689,583 | 8/1987 | Jerinic et al. | 331/56 |
| 4,764,741 | 8/1988 | Junger | 333/250 |
| 4,902,985 | 2/1990 | Arthur et al. | 330/287 |
| 4,930,035 | 5/1990 | Viana et al. | 361/54 |

FOREIGN PATENT DOCUMENTS 2192311 1/1988 United Kingdom .

OTHER PUBLICATIONS

Bosch et al., "Switching Performance of MM-Wave PIN Diodes for Ultra High Data Rates", 1977 IEEE MTT-S International Microwave Symposium Digest, Jun. 21-23, 1977, pp. 212-215a.

W-Band Power Combiner, Kai Chang, Roy L. Ebert, IEEE Transactions on MTT, vol. MTT-28, No. 4, Apr. 1980, pp. 295/305.

Theoretical and Experimental Analysis of a Waveguide Mounting Structure, Robert L. Eisenhart, Peter J. Kahn, IEEE Transactions on MTT, vol. MTT-19, No. 18 Aug. 1971 pp. 706/719.

High Power 44 HGz Solid State Amplifier Phase II, Raytheon Co. Final Technical Report RAY/RD S-4226, May 20, 1988.

*Primary Examiner*—Robert J. Pascal
*Assistant Examiner*—Seungsook Ham
*Attorney, Agent, or Firm*—Donald F. Mofford; Richard M. Sharkansky

[57] ABSTRACT

An RF switch circuit includes a waveguide transmission line having an input port, an output port, a first wall having a first cavity disposed therein and a second wall having a second cavity disposed therein with the first and second cavities being aligned along a centerline of the waveguide transmission line and means for providing a substantially short circuit impedance characteristic between the first cavity and the waveguide transmission line to RF signals propagating along the waveguide transmission line. The circuit further includes an electrically conductive member disposed in a first region of the second cavity, a diode having a first electrode disposed on a first surface of the electrically conductive member and an electrically conductive post having a first end disposed in the first cavity and having a second end disposed in the second cavity with the second end of the post electrically contacting a second electrode of the diode.

15 Claims, 3 Drawing Sheets

WAVEGUIDE SWITCH CIRCUIT WITH IMPROVED SWITCHING AND TUNING CAPABILITY

The Government has rights to this invention pursuant to Contract No. N00019-88-C-0152 award by the Department of the Navy.

BACKGROUND OF THE INVENTION

This invention relates generally to radio frequency circuits and more particularly to radio frequency switch circuits.

As is known in the art, a radio frequency (RF) switch circuit (hereinafter switch or switch circuit) is a device used to connect and disconnect RF signal paths in an electrical circuit. When connecting RF signal paths, a switch generally provides a bi-directional RF signal path. Thus, signals fed to an input port of the switch appear at an output port of the switch and vice-versa.

When the switch provides a signal path having a relatively low insertion loss characteristic between the input and the output port, the switch is generally referred to as being in the "on" position. When the switch provides a signal path having a relatively high insertion loss characteristic between the input port and the output port the switch is generally referred to as being in the "off" position.

The electrical characteristics of an RF switch include isolation, insertion loss, switching speed and RF power handling capability. Depending upon the particular application it is often necessary to optimize one of these electrical characteristics by trading off the performance of the other electrical characteristics of the switch.

For example, in a pulse radar systems which uses a common antenna to both transmit and receive signals, a component such as a duplexer, a circulator or the like provides isolated signal paths which couple a transmitter and a receiver to the common antenna. Components such as duplexers, circulators or the like, however, have a finite isolation characteristic. During transmit, portions of the transmit signal may leak back to the receiver due to the relatively poor isolation characteristics of the components which provide the receive path and transmit path to the common antenna. Moreover impedance mismatches between the antenna input port and the transmitter may cause high power RF signals from the transmitter to be reflected to the RF receiver. Thus, to protect the receiver from such undesired signals which are provided during the transmit mode, an RF switch circuit capable of withstanding high power RF signal levels may be disposed between the RF receiver and the duplexer for example.

Furthermore, in the pulse radar system the RF switch circuit must be able to switch between its "on" and "off" states at a rate greater than the pulse repetition frequency of the transmitter. When the transmitter provides a signal pulse, the switch is in its "off" or protection state and thus the switch protects the components of the receiver from high power RF signals by disconnecting the RF signal path to the RF receiver. When the transmitter is not providing a signal pulse the switch is in its "on" or "non-protection" state and thus the switch couples RF signals from the duplexer to the receiver.

One type of switch circuit which protects receivers from high power RF signals includes a plurality of PIN diodes connected in shunt across a transmission line at points on the transmission line separated from one another by one quarter wavelength at a particular frequency of operation. Since the diode connected closest to the input port of the switch has the highest power level incident thereon, this diode should have a higher breakdown voltage characteristic than the diode connected closest to the output port of the switch. Thus, the breakdown voltage of each PIN diode should correspondingly decrease from the input port to the output port of the switch.

The increase in breakdown voltage is typically achieved by increasing the thickness of the intrinsic region of the PIN diode. As is known, as the intrinsic region thickness increases the shunt resistance of the diode increases. However, as is also known, as the intrinsic region thickness is increased the capacitance of the diode decreases. This results in a concomitant decrease in the switching speed of the diode (i.e. its takes longer to switch the diode between its conducting and nonconducting states). Thus a trade off is made between the power handling capability and switching speed of the switch.

When the switch is in the non-protection mode the diodes are reversed bias and provide high shunt resistance so that substantially all of the RF signal power fed to the input port of the switch propagates along the RF transmission line relatively unattenuated to the output port of the switch.

However when the switch is in its protection mode the diodes are placed in their forward conducting state and provide a low impedance path between the RF transmission line and ground. RF signals fed to the input port of the switch are shunted to ground through the forward biased diodes. A portion of the RF power dissipates in the diodes due to the resistance of the diodes and thus the diodes are heated.

If the diodes are unable to dissipate the heat which is generated the diodes are damaged. Thus it is desirable to channel the heat away from the PIN diodes via a heat sink.

Conventional waveguide switch circuits include a plurality of diodes disposed in a transverse plane of the waveguide transmission line. By disposing the diodes in the transverse plane of the waveguide transmission line a problem is that the diodes are not provided with a heat sink. Thus, such a waveguide switch circuit is not able to handle high power RF signals.

Alternatively, in another approach a diode may be disposed in a bottom wall of a waveguide transmission line having a rectangular cross-section and partially protruding into the waveguide transmission line with an electrically conductive post disposed between the diode and a top wall of the waveguide transmission line. By disposing the diode partially in the waveguide wall and partially in the waveguide transmission line a heat sink is provided to the diode. However, one problem with this technique is that such circuits are relatively difficult to tune. Nevertheless, this technique is used in waveguide switch circuits because of the low insertion loss characteristic the switch provides in its "on state. Thus, when the diode is forward biased placing the switch in its "on" state the structure is highly resonant and therefore provides the switch having a relatively low insertion loss characteristic.

Other microwave circuits also use resonant structures disposed along the waveguide transmission line. For example, as is known in the art, a negative resistance device, such as an IMPATT diode for example, is often used as an oscillator or an amplifier to convert DC power to RF power. IMPATT diode oscillator circuits generally include a waveguide transmission line having a rectangular cross-section and having an electrically conductive member transversely disposed across one end of the waveguide to provide a short circuit impedance characteristic across the end of the waveguide transmission line. Thus the waveguide transmission line having a short circuit at one end provides a resonant waveguide cavity.

A plurality of IMPATT diodes which feed RF signals into the cavity may be disposed in the side walls of the waveguide cavity and spaced along the sidewalls of the cavity at half wavelength intervals. Each of the IMPATT diodes are provided having matching circuits to match the impedance of the IMPATT diodes to the impedance of the waveguide cavity over a pre-determined range of frequencies.

In one embodiment of an IMPATT diode oscillator circuit described in U.S. Pat. No. 4,583,058 and assigned to the assignee of the present invention each one of the diode oscillators includes a center conductor having a first end connected to a first end of an IMPATT diode. A second end of the IMPATT diode is connected to a heat sink. A ring shaped member is disposed about the center conductor and spaces the IMPATT diode from the resonant waveguide cavity. A second end of the center conductor has a tapered sleeve section to provide a stabilizing load used to terminate the diode oscillator in a characteristic impedance. Several of such IMPATT diode oscillator circuits may be disposed around a power combiner circuit which combines the power of such IMPATT diode oscillator circuits to provide high power RF signals over a relatively broad range of operating frequencies.

SUMMARY OF THE INVENTION

In accordance with the present invention, a switch circuit includes a waveguide transmission line having an input port, an output port, a first wall having a first cavity disposed therein and a second opposing wall having a second cavity disposed therein with the first and second wall cavities being aligned along a center-line of the waveguide transmission line. The switch further includes means for providing a substantially short circuit impedance characteristic between the first cavity and the waveguide transmission line to RF signals propagating along the waveguide transmission line. An electrically conductive member is disposed in a first region of the second cavity and a diode is disposed on a first surface of said electrically conductive member with a first electrode of said diode contacting said electrically conductive member. An electrically conductive post having a first end disposed in the first cavity and having a second end disposed in the second cavity electrically contacts a second electrode of the diode. With this particular arrangement, a waveguide switch circuit is provided. In particular the switch is capable of switching high power levels while also having a fast switching speed and a relatively low insertion loss characteristic. In conventional waveguide switch circuits excessive heating damages the diode. In the present invention the diode is disposed in the second wall of the waveguide and thus the second waveguide wall provides a large thermal mass to act as a heat sink for the diode. Thus the diodes can dissipate more heat provided from absorption of the high power RF signals fed thereto. Therefore compared to prior techniques, smaller diodes having faster switching speeds may be used to provide the RF switch circuit having a overall increased switching speed. One or more electrically conductive disks (choke spacers) may be disposed about a RF choke to space the RF choke a predetermined distance from an aperture disposed between the first cavity and the waveguide transmission line. The electrically conductive post and the diode form a resonant circuit in the waveguide. Electrically conductive disks (diode spacers) may be disposed between the conductive member and the waveguide transmission line to space the diode a predetermined distance from the waveguide transmission line. By spacing the diode with the diode spacers and the RF choke with the choke spacers the resonant circuit may be "tuned" to provide the switch having a relatively low insertion loss characteristic in its "on" state. In accordance with a further aspect of the present invention, a plurality of said resonant circuit structures are disposed in the waveguide transmission line and spaced at quarter wavelength intervals along a longitudinal axis of the waveguide transmission line to provide the switch having a high isolation characteristic in its "off" state.

BRIEF DESCRIPTION OF THE DRAWINGS

The foregoing features of this invention as well as the invention itself may be more fully understood from the following description of the drawings in which.

DESCRIPTION OF THE PREFERRED EMBODIMENTS

Figure 1:
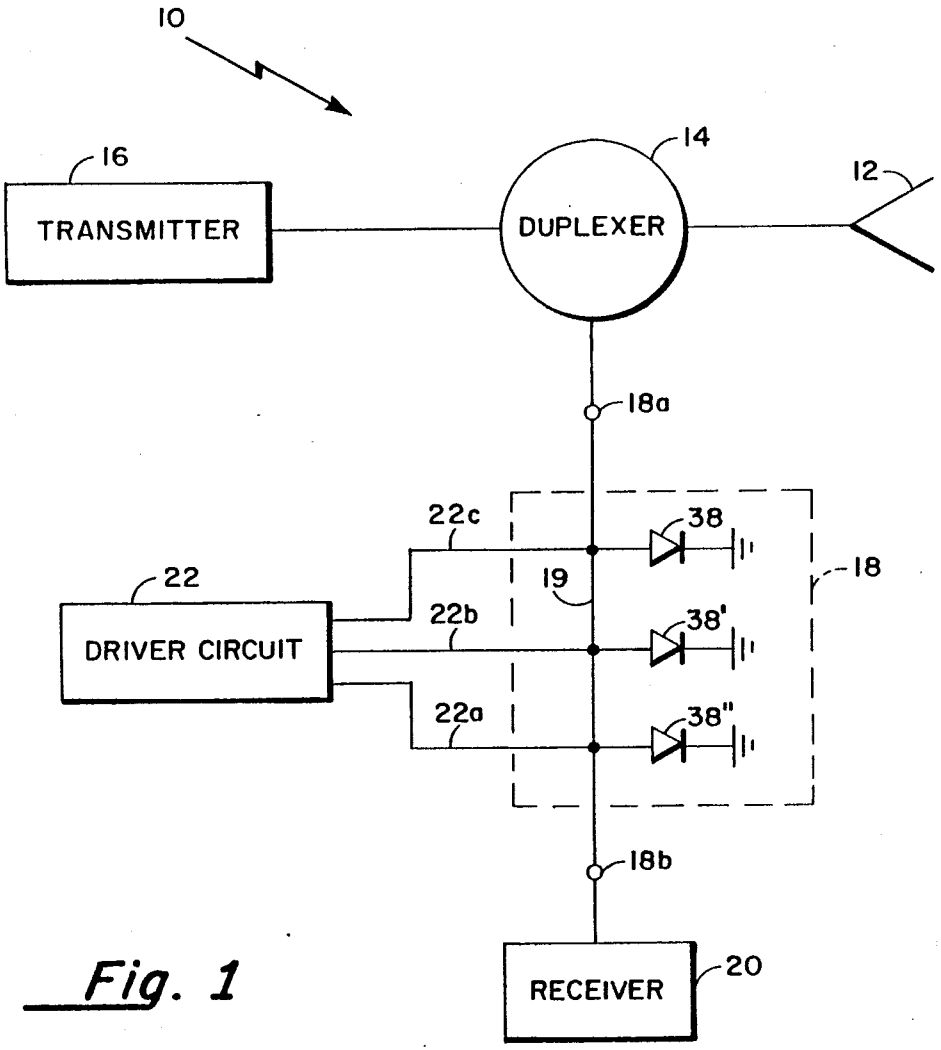
FIG. 1 is a block diagram of an RF receiving and transmitting system.

Referring now to FIG. 1, an RF system 10 such as a radar is shown to include an antenna 12 coupled to a duplexer circuit 14. The duplexer 14 includes a pair of isolated signal paths (not referenced) with a first signal path (not referenced) of the duplexer 14 disposed between the antenna 12 and the transmitter 16 and a second signal path (not referenced) of the duplexer 14 disposed between the antenna 12 and an RF switch circuit (hereinafter switch) 18 having an input port **18*a* and an output port 18*b***.

Figure 2:
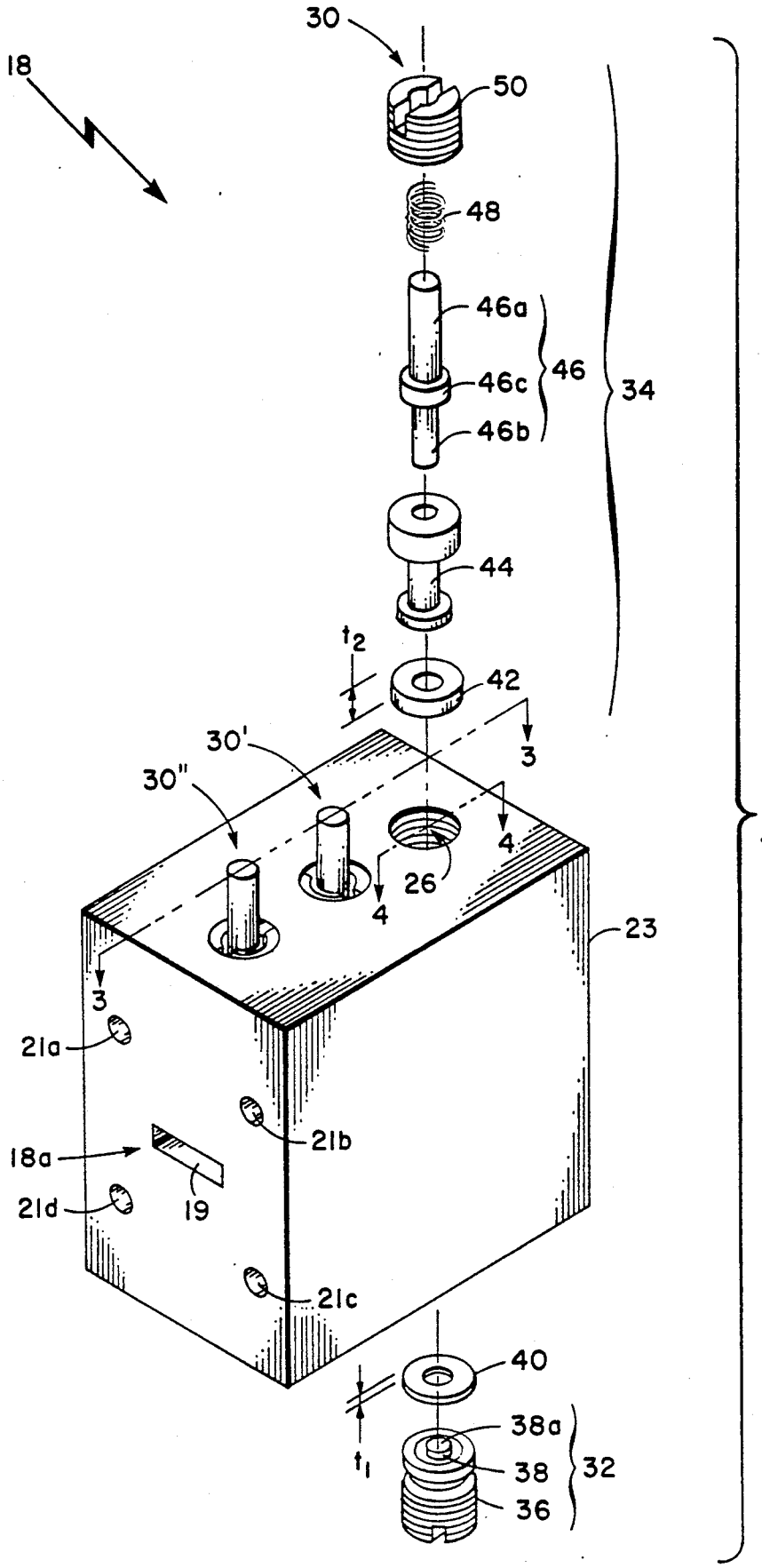
FIG. 2 is an exploded isometric diagrammatical view of an RF switch circuit of the type shown in FIG. 1.

The switch 18, as will be further described in conjunction with FIG. 2, couples RF signals from the duplexer 14 to a receiver 20. The switch 18 is here provided having three diodes 38, 38' and 38'', each of said diodes having an anode coupled to an RF propagation network 19 and a cathode coupled to ground. A driver circuit 22 provides a DC voltage or a DC current at each of the output terminals **22*a*, 22*b* and 22*c*. Each of the output terminals 22*a*–22*c* are coupled to a corresponding one of the diodes 38-38'' of the switch 18. The driver circuit 22 provides either a forward bias current or a reverse bias voltage at terminals 22*a*, 22*b* and 22*c* to respectively switch the PIN diodes 38-38''** between their conducting and non-conducting states.

During a transmit mode of operation of the RF system 10 the transmitter 16 provides a transmit signal to the duplexer 14 and the driver circuit 22 provides a forward bias current to the PIN diodes 38-38'' placing the diodes 38, 38', 38'' in their conducting state. In the forward biased state, the diodes 38-38'' provide a short circuit impedance in the waveguide transmission line. Thus, substantially all of the RF signal energy provided to the input port 18*a* is reflected back toward the input port 18*a*.

However, due to the resistance of the diodes 38-38'' a portion of the RF energy is coupled to and dissipated in the diodes 38-38'' and a highly attenuated RF signal emerges at the output port 18*b*. Thus the switch 18 protects the RF receiver 20 from RF transmit signals provided from the duplexer 14 in the transmit mode of the radar system 10.

When the transmitter 16 is not providing a transmit signal, the driver circuit 22 provides a reverse bias voltage to the diodes 38-38'' and places each of the diodes 38-38'' in its non-conducting state. In this instance the switch 18 is placed in its non-protection state and couples signals from the duplexer 14 to the RF receiver 20 with a relatively small amount of attenuation. Thus the driver circuit 22 switches the switch 18 between its protection and non-protection states.

Figure 3:
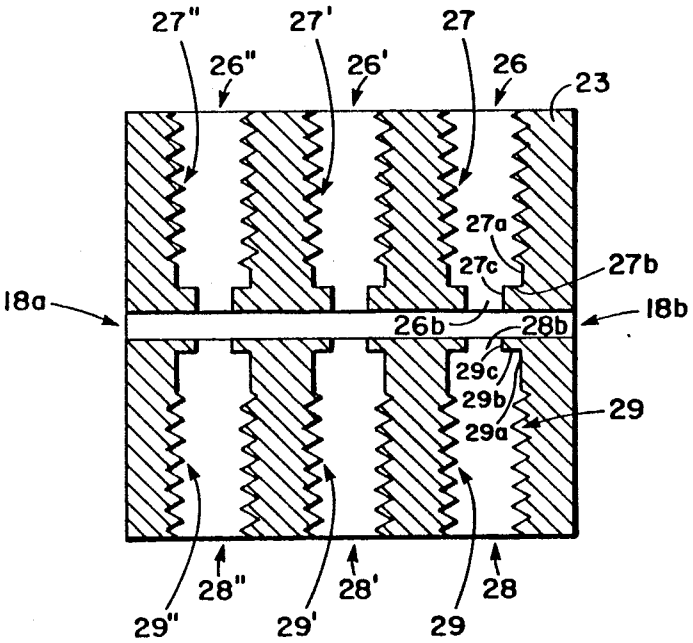
FIG. 3 is a cross-sectional view of a waveguide housing of the type used in the RF switch circuit of FIG. 2 without diode resonators taken along line 3—3 of FIG. 2.

Referring now to FIGS. 2 and 3, the switch circuit 18 of FIG. 1 is shown to include a housing 23 having an aperture of rectangular cross-section disposed therethrough to provide a rectangular waveguide transmission line 19 having a first port 18*a* corresponding to the input port of the switch circuit 18 and a second port 18*b* (FIG. 3) corresponding t the output port of the switch circuit 18.

Here the waveguide transmission line 19 is provided as a so-called half-height waveguide transmission line. It should be noted however that waveguide transmission line 19 may alternatively be provided as a full-height rectangular waveguide transmission line, a quarter height rectangular waveguide transmission line or even a circular waveguide transmission line.

A plurality of cavities having circular cross-section 26, 26' and 26'' are disposed in a first or here top wall of the housing 23 aligned with and spaced along a centerline of the waveguide transmission line 19. Likewise, a corresponding plurality of cavities 28, 28' and 28'' (FIG. 3) are disposed in a second or here bottom wall of housing 23 aligned with a spaced along the centerline of the waveguide transmission line.

As shown in FIG. 3, the cavities 26-26'' and 28-28'' are disposed in the top and bottom walls respectively of the housing 23. Taking the cavity 26 as representative of the cavities 26-26'', the cavity 26 is provided having a first threaded region 27, a second region 27*a* having no threads, a shoulder 27*c* having a surface 27*b* and an aperture 26*b* exposing the cavity 26 to the waveguide transmission line 19. Likewise, taking lower cavity 28 as representative of the cavities 28-28'', the cavity 28 is provided having a first threaded region 29, a second region 29*a* having no threads, a shoulder having a surface 29*b* and an aperture 28*b* have unthreaded sidewalls 29*c* exposing the cavity 28 to the waveguide transmission line 19.

Referring back to FIG. 2, the switch 18 includes three so-called resonant sections 30, 30' and 30'' spaced at odd multiples of one-quarter wavelength ($\lambda/4$) along the waveguide transmission line 19. Here said resonant sections 30-30'' are spaced at three-quarter wavelength ($3\lambda/4$) intervals along the center of the top and bottom walls of the waveguide transmission line 19. One-quarter wavelength spacing intervals can also be used and in some applications would be preferred due to the concomitant reduction that single quarter-wavelength spacing would provide in the length of the waveguide transmission line 19.

Taking resonant section 30 as representative of resonant sections 30', 30'', the resonant section 30 is shown to include a diode assembly 32 and an RF choke assembly 34. The diode assembly 32 includes a diode holder 36 which here is provided as a threaded conductive member having a circular cross-section. The diode holder 36 is preferably provided from a material having relatively high electrical and thermal conductivity for reasons to be discussed in conjunction with FIG. 4. Here diode holder 36 is provided as a single member. Alternatively, the diode 38 may be disposed on a separate threaded member 37 shown in phantom which screws into the diode holder 36.

The diode assembly 32 also includes a diode 38 having an anode 38*a* and a cathode (not numbered). The diode 38 is disposed on a first surface of the electrically conductive member 36 with the cathode of the diode 38 in contact with the first surface of the electrically conductive member 36. The diode assembly 32 is then disposed in the cavity 28 (FIG. 3). Here the diode assembly 32 screws into the threads 29 of the cavity 28.

Prior to the insertion of the diode assembly 32 into the cavity 28, a so-called diode spacer 40 having a thickness $t_1$, and which will be discussed further in conjunction with FIG. 4 may optionally be disposed in the cavity 28 (FIG. 3). Suffice it here to say the diode spacer 40 contacts the surface 28*a* (FIG. 3) of the shoulder and thus spaces the diode 38 a predetermined distance from the aperture 28*b* (FIG. 3).

The RF choke assembly 34 includes an optional choke spacer 42, here provided as an electrically conductive annular disk having a thickness $t_2$, and an RF choke 44 having a spool shape and having an axial bore therein and provided from an electrically conductive material. The RF choke 44 will be further described in conjunction with FIG. 4. The RF choke assembly 34 further includes an electrically conductive post 46 having a first region 46*a* of a first diameter, a second region 46*b* of a second diameter and a cylindrically shaped sleeve 46*c* disposed between the first and second regions and having a third diameter. The assembly further includes a spring 48 and a dielectric member 50 having a cylindrical shape and having a bore therein.

To assemble the RF choke assembly 34, the optional choke spacer 42 is disposed in the cavity 26 with a first surface of the spacer 42 in contact with the surface 27*b* of the shoulder (FIG. 3). The RF choke 44 is then disposed in the cavity 26 with a bottom base surface thereof resting on a second surface of the choke spacer 42. The post 46 is disposed in the cavity 26 with the region 46*b* disposed through the bore of the RF choke 44 and through the center of the choke spacer 42. The spring 48 is disposed over the first region 46*a* of the post 46 and rests on a first surface of the sleeve 46*c* and the dielectric member 50 is disposed over the first and second regions 46*a*, 46*c* of the post 46 and rests on a top base surface of the RF choke 44. The spring 48 is thus compressed and exerts a force on the sleeve of the post 46. A second end of the post 46 thus exerts a force on the diode 38. Here, the dielectric member 50 is threaded and thus screws into the threads of the cavity 26 to secure the RF choke assembly 34 in the cavity 26.

It should be noted that resonant sections 30-30'' are here disposed along the centerline of the longitudinal axis of the waveguide transmission line 19. Alternatively, the resonant sections may be disposed adjacent to the longitudinal centerline of the waveguide transmission line 19. In this instance two of such resonant sections may be adjacently disposed about the centerline of the longitudinal axis of the waveguide transmission line 19. The electric field of a dominant mode RF signal propagating along the waveguide transmission line 19 has sinusoidal shape with a voltage maximum along the center of the longitudinal axis of the waveguide. By adjacently disposing the resonant sections about the center line of the longitudinal axis of the waveguide transmission line 19, less voltage is incident upon each diode. Thus the diode absorbs less RF energy and dissipates less heat allowing even smaller, faster switching diodes to be used in the switch circuit 18.

Figure 4A:
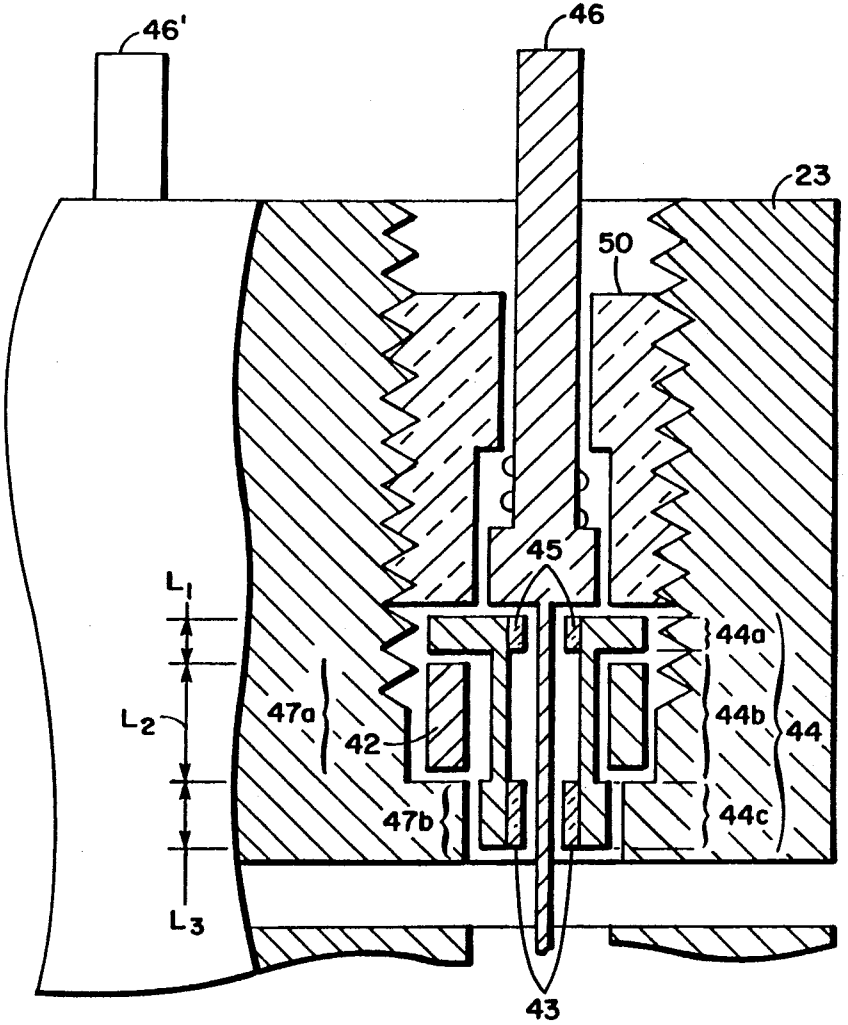
FIG. 4A is an enlarged view of an RF choke taken along lines 4A—4A of FIG. 4 used in the switch circuit of FIGS. 2 and 4.
Figure 4:
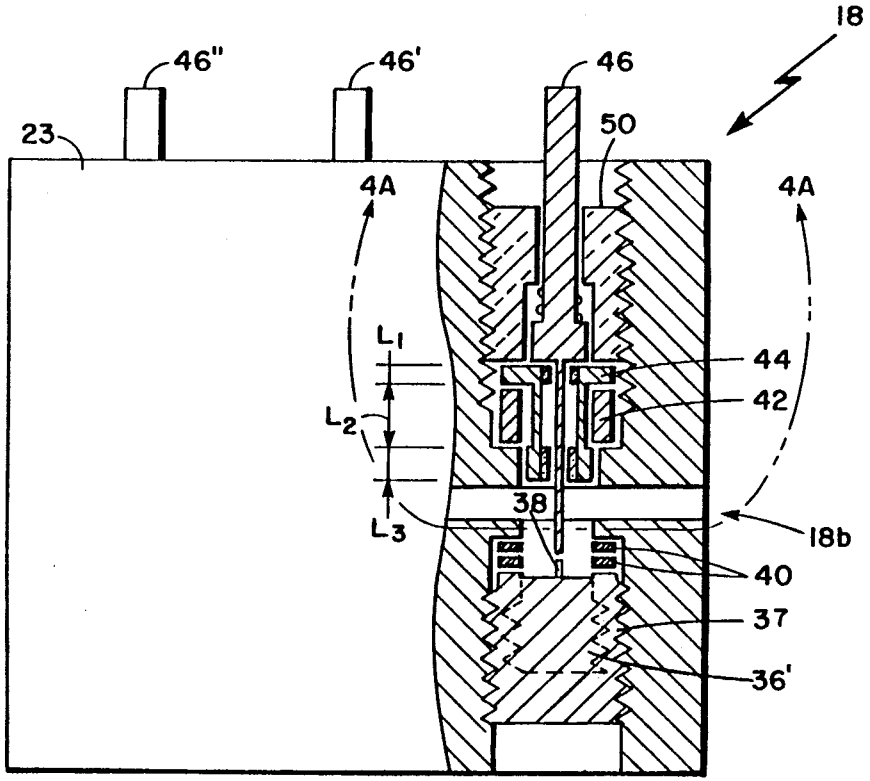
FIG. 4 is a cut away cross-sectional view of the assembled resonator section disposed in the waveguide housing of FIG. 3 taken along line 4—4 of FIG. 2.

Referring now to FIG. 4, in which like elements of the switch 18 of FIGS. 2 and 3 are provided with the same designations, the resonant section 30 is here shown assembled having a first end of the post 46 contacting the anode of the diode 38. The diode 38 is disposed on the electrically conductive member 36 using any technique well known to those of skill in the art which allows mounting of such diodes with good thermal contact. Here two diode spacers 40 are disposed in the cavity 28 to space the diode 38 a predetermined distance from the aperture **28*b* (FIG. 3) which exposes the waveguide transmission line 19. Similarly, here the choke spacer 42 spaces the RF choke 44 a predetermined distance from the aperture 26*b* (FIG. 3) exposing the waveguide transmission line 19. As will be further discussed below, any number of choke spacers 42 or diode spacers 40 may be disposed in the cavities 26, 28**. Furthermore, such choke spacers and diode spacers need not be provided having equal thickness.

Referring momentarily to FIG. 4A, an enlarged view of a portion of the RF choke assembly is shown. It should here be noted that the RF choke 44 is provided having a first region **44*a* having a physical pathlength $L_1$, a second region 44*b* having a physical pathlength $L_2$ and a third region 44*c* having a physical pathlength $L_3$. A dielectric material 43 is disposed between the conductive post 46 and the third region 44*c* of the RF choke 44 to prevent the post 46 from contacting the RF choke 44 and causing a short circuit between the post 46 and the choke 44. The dielectric material 43 should have a relatively low dielectric constant typically of about 2.54 to keep the Q of the RF choke assembly 34 high and therefore keep the loss low. The dielectric material 43** may be provided for example as rexolite or any other low loss plastic dielectric material.

The RF choke 44 and the shoulder **46*b* of the electrically conductive post 46 are dielectrically spaced, (i.e. they are not in electrical contact) here said dielectric being air. The dielectric member 50 prevents the shoulder from electrically contacting said RF choke. Similarly, a radar absorbing material (RAM) 45 is disposed on a peripheral surface of the axial bore in a top rim region 44*a* of the RF choke 44. The RAM 45 may be provided for example as the type manufactured by Emmerson Cummings having part number MFSOOF-117. Alternatively, any RF absorber material having similar electrical characteristics may be used. The radar absorbing material 45 prevents the peripheral surface of the axial bore from electrically contacting that portion of the post 46 disposed therethrough. Further, the RAM 45 terminates any RF signals leaking past the RF choke 44**.

The outer peripheral surface of the second region **44*b* of the spool shaped RF choke 44 provides the inside diameter of section of a coaxial transmission line 47*a* having a high impedance characteristic and having a physical pathlength $L_2$ which corresponds to an electrical path length of one quarter wavelength at a desired frequency of operation. An inner peripheral surface of the choke spacer 42 provides the outside diameter of the high impedance coaxial line section 47*a***.

The outer peripheral surface of the third region **44*c* of the RF choke 44 provides the inside diameter of section of a low impedance coaxial transmission line 47*b*** having a physical pathlength $L_3$. A corresponding portion of the cavity wall provides the outside diameter of the low impedance coaxial line section.

A dielectric material, which may be comprised of polyamide for example, is disposed on the outer peripheral surface of the RF choke 44 in the region **44*c* having the pathlength L3. Such a dielectric coating prevents the surface of region 44*c* of the RF choke 44 from coming into electrical contact with the wall of the cavity 26 and also dielectrically "loads" the coaxial line section 47*b* to make the physical pathlength $L_3$ correspond to an electrical pathlength of one quarter wavelength. Thus, both the high impedance and the low impedance sections of coaxial transmission line 47*a*, 47*b*** have an electrical pathlength corresponding to one quarter wavelength at a predetermined frequency of operation.

The RF choke provides a short circuit impedance characteristic at the aperture **26*b* (FIG. 3) and thus prevents RF signal energy from propagating into the cavity 26. The choke space 42 is used to adjust the distance of the RF choke 44 from the aperture 26*b* (FIG. 3) to thus provide the short circuit impedance characteristic precisely at the aperture 26*b***.

Referring again to FIG. 4, the driver circuit 22 (FIG. 1) is coupled to the post 46 in the region **46*a* to provide bias voltages and currents to the PIN diode 38. Here, driver circuit 22 (FIG. 1) provides the diode 38 with separate bias signals from the diodes 38', 38'**.

In operation when a reverse bias voltage is provided to the anode of the diode 38, the diode 38 is placed in its non-conductive state and the diode 38 provides a high impedance path between the post 46 and the waveguide wall (not numbered) provided by the housing 23. The post 46 in conjunction with the capacitance of the reversed biased diode provides a resonant circuit. That is the length of the post section **46*b* in combination with the impedance characteristic of the diode 38 is selected to be resonant at the desired frequency of operation. Thus the signal propagates along the waveguide transmission line 19** relatively unattenuated.

However when a forward bias current is provided to the anode of the diode 38, the diode 38 is placed in its conductive state and provides a low impedance path between the post 46 and the waveguide wall (not numbered) provided by the housing 23. In this instance the post provides a highly inductive impedance to the waveguide transmission line 19. The post 46 and the diode 38 are disposed along the center of the waveguide transmission line 19 where the dominant mode electric field is concentrated. Thus signals propagating along the waveguide transmission line are shunted to ground via the conductive post 46 and diode 38 and therefore the signals are substantially reflected with only a small portion of the RF energy propagating from the input port 18*a* to the output port 18*b*.

The resonant section 30 is tuned by physically adjusting the distance of the diode 38 and the RF choke 44 from the apertures 26*b*, 28*b*. The choke spacers 42 are used to adjust the distance between the RF choke 44 and the aperture 26*b*. Similarly, the diode spacers 40 are used to adjust the distance between the diode 38 and the aperture 28*b*. Each resonator section 30-30″ may be provided having a different number of choke spacers 42 and diode spacers 40. Thus each resonant section 30-30″ may be tuned separately to provide the switch 18 having the overall desired insertion loss and isolation characteristics.

If each of the diodes 38-38″ are reversed biased and thus placed in their non-conducting state, the switch 18 provides a minimum insertion loss characteristic to signals fed thereto. If each of the diodes 38-38″ are forward biased and thus placed in their conducting states the switch 18 provides a maximum insertion loss characteristic to signals fed thereto.

Alternatively, since each diode 38-38″ may be biased independently of the others a first one of the diodes, 38″ for example, may be reversed biased and the second and third diodes 38, 38″ may be forward biased to provide an attenuation step. That is the switch will not be completely turned off and will allow at least a portion of an RF signal fed to the input port 18*a* to propagate to the output port 18*b*. Thus the switch 18 may provide either a high insertion loss state, an intermediate insertion loss state or a low insertion loss state.

Such a feature may be desirable in a radar system for example since the intermediate insertion loss state of the switch 18 may be used to allow an RF receiver to continue to receive RF signals having a power level which would not damage components in the receiver 20 (FIG. 1). Thus such a feature should effectively extend the dynamic range of the receiver 20.

Furthermore the diode 38,, is here provided as a so-called high power PIN diode and the diodes 38, 38′ are provided as so-called attenuator diodes. By providing the diode 38″ as a high power PIN diode the switch 18 is provided having a high RF power handling characteristic. By providing the diodes 38, 38′ as attenuator diodes the switch 18 is provided having a fast switching speed in the intermediate attenuation state.

Moreover, since the diodes 38-38″ are disposed on the conductive members 36-36″ which provide an effective heat sink each of the diodes 38-38″ are not as thermally limited as in the conventional approach. That is here each of the diodes 38-38″ ar disposed on a larger heat sink than in the conventional approach. Thus each of the diodes may be provided having a smaller intrinsic region for a given input power level compared to the diodes used in prior techniques.

PIN diodes having a small intrinsic region are generally able to switch between their conducting and nonconducting states more quickly than diodes having a large intrinsic region. Thus, the switch 18 is provided having a high RF power handling capability and a fast switching speed.

Having described preferred embodiments of the invention, it will now become apparent to one of skill in the art that other embodiments incorporating their concepts may be used. This same technique for example may be used to provide a low loss passive limiter circuit. It is felt, therefore, that these embodiments should not be limited to disclosed embodiments, but rather should be limited only by the spirit and scope of the appended claims.

What is claimed is:

1. A circuit comprising:

a waveguide transmission line having an input port, an output port, a first wall surface having an aperture communicating with a first cavity disposed therein and a second wall surface having a second cavity disposed therein said first and second cavities being disposed along the waveguide transmission line;

an electrically conductive member disposed in a first region of said second cavity;

a diode having a conducting state and a nonconducting state and a first and a second electrode, the first electrode disposed on a first surface of said electrically conductive member;

an electrically conductive post having a first end disposed in said first cavity and having a second end disposed in said second cavity with said second end electrically contacting the second electrode of said diode;

means for providing a short circuit impedance characteristic when said diode is in a conducting state and alternatively an open circuit impedance characteristic when said diode is in a nonconducting state between the electrically conductive post and the second wall surface of the waveguide transmission line; and means for providing a low impedance characteristic between said electrically conductive post and said first wall surface of the waveguide transmission line to RF signals propagating along said waveguide transmission line, said providing means comprising:

an RF choke means, having a portion of the electrically conductive post disposed therethrough, for providing a first region having a high impedance characteristic and for providing a second region having a low impedance characteristic; and means for disposing the RF choke means for providing the low impedance characteristic precisely at the aperture of the first wall surface.

2. The circuit of claim 1 wherein said means for providing a short circuit impedance characteristic comprises at least one electrically conductive ring shaped member disposed between said electrically conductive member and the waveguide transmission line to control the disposition of the diode from the waveguide transmission line.

3. The circuit of claim 1 wherein said means for disposing the RF choke means comprises:

at least one electrically conductive ring shaped member disposed about a portion of said RF choke means.

4. The circuit of claim 3 further comprising means for pressing said electrically conductive post against the second electrode of said diode.

5. The circuit of claim 4 wherein said waveguide transmission line is provided as a half-height rectangular waveguide transmission line.

6. The circuit of claim 5 wherein said diode is a PIN diode.

7. A switch circuit comprising:

a waveguide transmission line having an input port, an output port, a top wall and a bottom wall;

a plurality of resonant circuits disposed along the waveguide transmission line, each of said plurality of resonant circuits being spaced along said waveguide transmission line by an integer multiple of one-quarter wavelength at a first frequency and each of said resonant circuits comprising:

a first cavity having an aperture disposed in the top wall of said waveguide transmission line;

a corresponding second cavity disposed in the bottom wall of said waveguide transmission line;

an electrically conductive member disposed in said second cavity;

a diode having a first and second electrode, the first electrode disposed on a first surface of said electrically conductive member;

an electrically conductive post having a first end disposed in said first cavity and having a second end disposed in said corresponding second cavity with the second end of said post electrically contacting the second electrode of said diode;

means for selectively providing a short circuit impedance characteristic when said diode is in a conducting state and an open circuit impedance characteristic when said diode is in a nonconducting state between the electrically conductive post and the bottom wall of the waveguide transmission line; and means for providing a substantially short circuit impedance characteristic between said electrically conductive post and said top wall of the waveguide transmission line to RF signals propagating along said waveguide transmission line, said providing means comprising:

an RF choke means for providing a first region having a high impedance characteristic and for providing a second region having a low impedance characteristic; and means for disposing the RF choke means for providing the short circuit impedance characteristic at the aperture of the first cavity of the first wall.

8. The switch circuit of claim 7 further comprising means for pressing said electrically conductive post against the second electrode of said diode.

9. The switch of claim 8 wherein at least one of said diodes is a PIN diode.

10. The switch circuit of claim 7 wherein said waveguide transmission line is provided as a half-height rectangular waveguide transmission line.

11. A switch circuit comprising:

a housing having a waveguide transmission line disposed therein said waveguide transmission line having an input port and an output port;

a first portion of said housing having a first plurality of cavities disposed therein, each of said first plurality of cavities being aligned along said waveguide transmission line;

a second opposing portion of said housing having a corresponding second plurality of cavities disposed therein, each of said second plurality of cavities being aligned opposite a corresponding one of said first plurality of cavities;

a plurality of electrically conductive members, each electrically conductive member disposed in each of said second plurality of cavities;

a plurality of diodes, each one of said diodes having a first electrode disposed on a first surface of a corresponding one said plurality of electrically conductive members;

a corresponding plurality of electrically conductive posts, each one of said posts having a first end disposed in a corresponding one of said first plurality of cavities and having a second end disposed in a corresponding one of said second plurality of cavities and each of said second ends electrically contacting a second electrode of a corresponding one of said plurality of diodes, each of said electrically conductive posts providing a short circuit impedance characteristic to RF signals propagating therethrough when said corresponding diode is in a conductive state and an open circuit impedance characteristic to RF signals propagating therethrough when said corresponding diode is in a nonconductive state; and a plurality of RF chokes, each RF choke disposed in a corresponding one of the first plurality of cavities, each RF choke comprising:

an RF choke means for providing a first region having a high impedance characteristic and for providing a second region having a low impedance characteristic; and means for disposing the RF choke means for providing the short circuit impedance characteristic precisely at an opening of the corresponding one of the first plurality of cavities.

12. The switch circuit of claim 11 wherein the first electrodes of said plurality of diodes correspond to a cathode and the second electrodes of said plurality of diodes correspond to an anode.

13. The switch circuit of claim 12 wherein at least one of said diodes is a PIN diode.

14. The switch circuit of claim 13 wherein said waveguide transmission line is provided as a half-height waveguide transmission line.

15. A switch circuit comprising:

a waveguide transmission line having an input port, an output port, a top wall and a bottom wall;

a first cavity having an aperture disposed in the top wall of said waveguide transmission line;

a corresponding second cavity disposed in the bottom wall of said waveguide transmission line;

an electrically conductive member disposed in said second cavity;

a diode having a first and second electrode, the first electrode disposed on a first surface of said electrically conductive member;

an electrically conductive post having a first end disposed in said first cavity and having a second end disposed in said corresponding second cavity with the second end of said post electrically contacting the second electrode of said diode;

means for selectively providing a short circuit impedance characteristic when said diode is in a conducting state and an open circuit impedance characteristic when said diode is in a nonconducting state between the electrically conductive post and the bottom wall of the waveguide transmission line; and means for providing a substantially short circuit impedance characteristic between said electrically conductive post and said top wall of the waveguide transmission line to RF signals propagating along said waveguide transmission line, said providing means comprising:

an RF choke means for providing a first region having a high impedance characteristic and for providing a second region having a low impedance characteristic; and means for disposing the RF choke means for providing the short circuit impedance characteristic at the aperture of the first cavity of the first wall.

* * * * *